US010960411B2

(12) United States Patent
Nilsson et al.

(10) Patent No.: US 10,960,411 B2
(45) **Date of Patent: *Mar. 30, 2021**

(54) SEPARATION DISC FOR A CENTRIFUGAL SEPARATOR AND A METHOD FOR MANUFACTURING THE SEPARATION DISC

(71) Applicant: ALFA LAVAL CORPORATE AB, Lund (SE)

(72) Inventors: Sven-Ake Nilsson, Gnesta (SE); Peter Thorwid, Sundbyberg (SE)

(73) Assignee: ALFA LAVAL CORPORATE AB, Lund (SE)

( * ) Notice: Subject to any disclaimer, the term of this patent is extended or adjusted under 35 U.S.C. 154(b) by 601 days.

This patent is subject to a terminal disclaimer.

(21) Appl. No.: 15/882,695

(22) Filed: Jan. 29, 2018

(65) Prior Publication Data

US 2018/0147580 A1 May 31, 2018

Related U.S. Application Data

(63) Continuation of application No. 14/235,422, filed as application No. PCT/EP2012/065439 on Aug. 7, 2012, now Pat. No. 9,914,138.

(30) Foreign Application Priority Data

Aug. 10, 2011 (EP) ..... 11177101

(51) Int. Cl.
*B04B 7/14* (2006.01)
*B04B 1/08* (2006.01)
*B21D 22/16* (2006.01)

(52) U.S. Cl.
CPC ..... *B04B 7/14* (2013.01); *B04B 1/08* (2013.01); *B21D 22/16* (2013.01)

(58) Field of Classification Search
CPC ..... B04B 1/08; B04B 7/14; B21D 22/16
(Continued)

(56) References Cited

U.S. PATENT DOCUMENTS 1,006,622 A 10/1911 Bailey
1,602,752 A 10/1926 Cuthbert
(Continued)

FOREIGN PATENT DOCUMENTS

CN 1042671 A 6/1990
CN 1179736 A 4/1998
(Continued)

OTHER PUBLICATIONS

International Search Report, issued in PCT/EP2017/077238, dated Jan. 22, 2018.
(Continued)

*Primary Examiner* — Charles Cooley
(74) *Attorney, Agent, or Firm* — Birch, Stewart, Kolasch & Birch, LLP

(57) ABSTRACT

A separation disc for a centrifugal separator and a method for manufacturing the separation disc are disclosed. The separation disc is of metal material and adapted to be compressed in a stack of separation discs inside a centrifugal rotor for separating a liquid mixture. The separation disc has a truncated conical shape with an inner surface and an outer surface and a plurality of spacing members extending a certain height above at least one of the inner surface and the outer surface for providing interspaces between mutually adjacent separation discs in the stack. The spacing members are of such small size that each one of them has a width which is less than 2 mm along the surface of the separation disc. The surface of the separation disc is configured with a
(Continued)

distribution pattern of the small-sized spacing members, in such a way as to provide equidistant interspaces in the compressed disc stack.

19 Claims, 3 Drawing Sheets

(58) Field of Classification Search
USPC ..... 494/37, 67, 68, 73, 70–72; 72/208
See application file for complete search history.

(56) References Cited

U.S. PATENT DOCUMENTS

| | | | | |
|---|---|---|---|---|
| 2,028,955 | A | 1/1936 | Shenstone | |
| 2,599,619 | A * | 6/1952 | Eckers | B04B 7/14 494/28 |
| 2,725,190 | A | 11/1955 | Hein et al. | |
| 3,335,946 | A | 8/1967 | Putterlík | |
| 3,409,521 | A * | 11/1968 | Sharples | B04B 7/14 205/652 |
| 4,036,429 | A | 7/1977 | Ivin et al. | |
| 4,142,671 | A | 3/1979 | Ivin et al. | |
| 4,262,841 | A | 4/1981 | Berber et al. | |
| 4,622,029 | A | 11/1986 | Nilsson | |
| 4,861,329 | A * | 8/1989 | Borgstrom | B04B 7/14 494/73 |
| 5,637,217 | A | 6/1997 | Herman et al. | |
| 5,720,705 | A | 2/1998 | Inge et al. | |
| 5,883,354 | A * | 3/1999 | Elofson | B04B 7/14 219/117.1 |
| 6,526,794 | B1 * | 3/2003 | Langer | B04B 7/14 494/70 |
| 8,454,487 | B2 | 6/2013 | Lindroth et al. | |
| 8,562,503 | B2 | 10/2013 | Rudman et al. | |
| 8,678,989 | B2 | 3/2014 | Rudman et al. | |
| 9,550,192 | B2 * | 1/2017 | Klintenstedt | B04B 1/08 |
| 9,687,858 | B2 * | 6/2017 | Quiter | B04B 7/14 |
| 9,914,138 | B2 * | 3/2018 | Nilsson | B21D 22/16 |
| 10,118,184 | B2 | 11/2018 | Inge et al. | |
| 2001/0016549 | A1 | 8/2001 | Herman et al. | |
| 2003/0178014 | A1 * | 9/2003 | Sauter | B04B 5/12 123/572 |
| 2008/0015099 | A1 | 1/2008 | Heinrich | |
| 2010/0011723 | A1 * | 1/2010 | Szepessy | B04B 7/14 55/438 |
| 2011/0136649 | A1 * | 6/2011 | Lindroth | B04B 1/08 494/74 |
| 2011/0195832 | A1 | 8/2011 | Rudman et al. | |
| 2013/0067873 | A1 | 3/2013 | Szepessy et al. | |
| 2014/0148327 | A1 * | 5/2014 | Nilsson | B04B 1/08 494/70 |
| 2016/0001302 | A1 | 1/2016 | Quiter et al. | |
| 2016/0303579 | A1 * | 10/2016 | Nilsson | B21D 22/16 |
| 2018/0147580 | A1 * | 5/2018 | Nilsson | B21D 22/16 |
| 2019/0247865 | A1 * | 8/2019 | Nilsson | B04B 7/14 |
| 2019/0247866 | A1 * | 8/2019 | Nilsson | B04B 7/14 |
| 2019/0262843 | A1 | 8/2019 | Nilsson et al. | |

FOREIGN PATENT DOCUMENTS

| | | | |
|---|---|---|---|
| CN | 1615179 | A | 5/2005 |
| CN | 1832807 | A | 9/2006 |
| CN | 101619018 | A | 1/2010 |
| CN | 101862706 | A | 10/2010 |
| CN | 101884957 | A | 11/2010 |
| CN | 102083541 | A | 6/2011 |
| CN | 102099120 | A | 6/2011 |
| CN | 102227265 | A | 10/2011 |
| CN | 102227266 | A | 10/2011 |
| CN | 102821866 | A | 12/2012 |
| CN | 103357515 | A | 10/2013 |
| CN | 103702763 | A | 4/2014 |
| CN | 104284732 | A | 1/2015 |
| CN | 105188946 | A | 12/2015 |
| CN | 105813772 | A | 7/2016 |
| CN | 107771103 | A | 3/2018 |
| DE | 37 14399 | C1 | 4/1988 |
| DE | 195 37 268 | C1 | 2/1997 |
| DE | 696 06 973 | T2 | 6/2000 |
| EP | 0806985 | B1 | 7/2002 |
| GB | 466971 | A | 6/1937 |
| GB | 711695 | A | 7/1954 |
| GB | 1330097 | A | 9/1973 |
| JP | 53-63993 | A | 6/1978 |
| JP | 2001-505476 | A | 4/2001 |
| JP | 2002-239414 | A | 8/2002 |
| JP | 2010-274210 | A | 12/2010 |
| KR | 10-92-006647 | B1 | 8/1992 |
| KR | 10-2014-0034299 | A | 3/2014 |
| RU | 797778 | A1 | 1/1981 |
| RU | 1261715 | A1 | 10/1986 |
| RU | 17286 | U1 | 3/2001 |
| SE | 23367 | C1 | 7/1906 |
| SE | 528844 | C2 | 2/2007 |
| SE | 532153 | C2 | 11/2009 |
| WO | WO 90/05028 | A1 | 5/1990 |
| WO | 96/27445 | * | 12/1996 |
| WO | WO 2007/055630 | A1 | 5/2007 |
| WO | WO 2009/051545 | A1 | 4/2009 |
| WO | WO 2009/126104 | A1 | 10/2009 |
| WO | WO 2010/039097 | A1 | 4/2010 |
| WO | WO 2013/020978 | A1 | 2/2013 |
| WO | WO 2013/079194 | A2 | 6/2013 |
| WO | WO 2016/046944 | A1 | 3/2016 |

OTHER PUBLICATIONS

International Search Report, issued in PCT/EP2017/077248, dated Jan. 17, 2018.

International Search Report, issued in PCT/EP2017/077284, dated Jan. 17, 2018.

U.S. Office Action, dated May 29, 2020, for U.S. Appl. No. 16/342,095.

U.S. Office Action, dated May 29, 2020, for U.S. Appl. No. 16/342,103.

Written Opinion of the International Searching Authority, issued in PCT/EP2017/077238, dated Jan. 22, 2018.

Written Opinion of the International Searching Authority, issued in PCT/EP2017/077248, dated Jan. 17, 2018.

Written Opinion of the International Searching Authority, issued in PCT/EP2017/077284, dated Jan. 17, 2018.

English translation of the Korean Office Action for Korean Application No. 10-2019-7015262, dated Jun. 19, 2020.

* cited by examiner

Prior Art
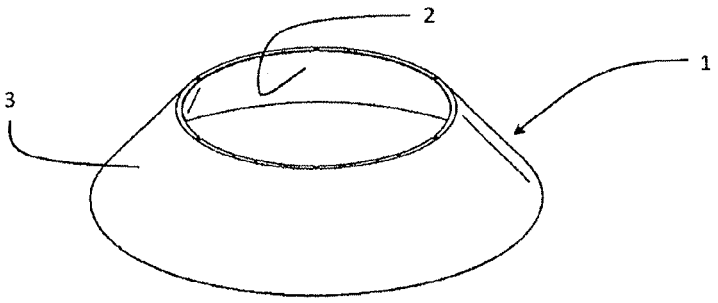
Fig. 1
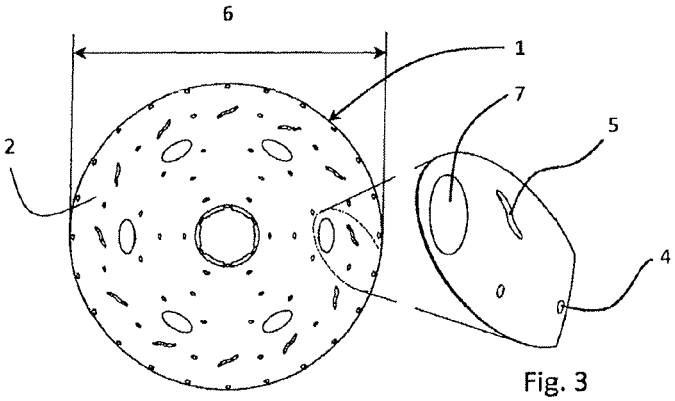
Fig. 3
Fig. 2

SEPARATION DISC FOR A CENTRIFUGAL SEPARATOR AND A METHOD FOR MANUFACTURING THE SEPARATION DISC

CROSS-REFERENCE TO RELATED APPLICATIONS

This application is a Continuation of copending U.S. application Ser. No. 14/235,422 filed on Feb. 4, 2014, which is the National Phase under 35 U.S.C. § 371 of International Application No. PCT/EP/2012/065439, filed on Aug. 7, 2012, which claims the benefit under 35 U.S.C. § 119(a) to Patent Application No. 11177101.0 filed in the EP on Aug. 10, 2011, all of which are hereby expressly incorporated by reference into the present application.

TECHNICAL FIELD

The invention relates to a separation disc for a centrifugal separator and a method for manufacturing the separation disc. In particular the invention relates to a separation disc made of metal material and which is adapted to be compressed in a stack of separation discs inside a centrifugal rotor for separating a liquid mixture, the separation disc having a truncated conical shape with an inner surface and an outer surface and a plurality of spacing members extending a certain height above at least one of the inner surface and the outer surface for providing interspaces between mutually adjacent separation discs in the stack.

BACKGROUND ART

Separation discs of metal are used in connection with relatively robust and large-sized centrifugal separators for separating liquid mixtures; wherein the separation discs are of relatively large size and exposed to both high centrifugal and liquid forces.

The separation discs are stacked at a mutual distance to form interspaces between themselves. The liquid mixture to be separated in the centrifugal rotor is conducted through the interspaces, wherein the liquid mixture is separated into phases of different densities during operation of the centrifugal separator. The interspaces are provided by said spacing members arranged on the surface of each separation disc. There are many ways of forming such spacing members. They may be formed by attaching separate members in the form of narrow strips or small circles of sheet metal to the separation disc, usually by spot welding them to the surface of the separation disc. The separation disc may also be manufactured with spacing members formed in one piece with the material of the separation disc itself. Known techniques for manufacturing separation discs with integrally formed spacing members are disclosed in for instance WO 2007/055630 A1 and U.S. Pat. No. 6,526,794 B1.

The size of the interspaces between the separation discs depends on how much the spacing members extend or protrude from the surface, i.e. the height of the spacing members. Dimensioning the size of the interspaces or height of the spacing members involves different aspects to be considered. For instance, it will depend on the type and amount of solids (sludge) being suspended in the liquid mixture. In general, the height (or size of the interspaces) will be dimensioned somewhere in the range of 0.3 to 0.8 mm.

Furthermore, the centrifugal rotor provides a separation space which is designed with a given total height for the stack of separation discs. In order to maximize the separating capacity of the centrifugal separator, there is a de-sire to fit as many separation discs as possible into the stack within that given height. More separation discs in the stack means more interspaces in which the liquid mixture can be separated. An optimum height on each of the individual interspaces will however usually be given by (or depend on) the type of liquid mixture which is intended to be separated. Consequently, this leaves the option of making the separation discs as thin as possible to maximize the number of separation discs within said given total stack height.

However, there's a lower limit as to how thin the separation discs can be made. Present day manufacturing techniques and in particular the material of the separation disc will define this lower limit. The thickness of the separation discs (i.e. without counting the spacing members) will typically be somewhere in the range from 0.3 to 0.6 mm. A separation disc having a small size (diameter) may exhibit a thickness of 0.4 mm, whereas a substantially larger separation disc may exhibit a thickness as great as 0.7 mm. Hence, the separation disc is in general made thicker with the size (diameter) of the separation disc. The centrifugal rotor will rotate at high speeds, and accordingly the separation discs are exposed to high centrifugal forces and strains during rotation. If the separation discs are made too thin, such strains would lead to material failure or permanent deformation.

Prior to this happening, there may be other problems with very thin separation discs. As the separation discs are made thinner, they will exhibit a loss in rigidity and irregularities in their shape may begin to appear. The separation discs are furthermore compressed in the stack inside the centrifugal rotor to form a tight unit. The thin separation discs may thereby flex and/or because of their irregular shaping give rise to unevenly sized interspaces in the stack of separation discs. Accordingly, in certain parts of the interspaces (e.g. far away from a spacing member), the mutually adjacent separation discs may be completely compressed against each other to leave no interspaces at all. In other parts of the interspaces (e.g. in the vicinity of a spacing member) the separation discs will not flex much and accordingly provide an adequate height.

A high performing disc stack depends however, among other things, on the interspaces being equidistant. Having the same height all over means that the liquid mixture is evenly distributed in the interspaces of the stack. In this way, the interspaces all contribute to the separation of the liquid mixture. This is important for each of the interspaces separately and in relation to each other. Consequently, different sized interspaces along the stack would cause uneven flow distribution, whereby certain interspaces are overloaded with flow, while other interspaces barely receive any flow at all. Such uneven flow distribution will in turn cause a decrease in the separating efficiency of the disc stack. This problem may also appear in each of the individual interspaces, wherein compressed parts barely receive any flow at all and consequently do not contribute to separating the liquid mixture.

SUMMARY

It is an object of the invention to provide a separation disc and a method for manufacturing such a separation disc which provides substantially equidistant interspaces in the compressed stack.

A separation disc is provided for a centrifugal separator, the separation disc being of metal material and adapted to be compressed in a stack of se-partition discs inside a centrifugal rotor for separating a liquid mixture, the separation disc being of truncated conical shape with an inner surface and an outer surface and a plurality of spacing members extending a certain height above at least one of the inner surface and the outer surface for providing interspaces between mutually adjacent separation discs in the stack. The separation disc is characterized in that at least some of the spacing members are of such small size that each one of the small-sized spacing members has a width which is less than 2 mm along the surface of the separation disc, the surface of the separation disc being configured with a distribution pattern of the small-sized spacing members, in such a way as to provide equidistant interspaces in the compressed disc stack.

If small-sized spacing members in large numbers are introduced on the surfaces of the thin metal separation discs then equidistant spaces may be achieved using even thinner separation discs than today. Hence, the separating capacity of the centrifugal separator can in this way be further increased by fitting a greater number of the thinner metal separation discs into the stack and still maintain equidistant interspaces. The invention will in this way facilitate the use of separation discs as thin as possible to maximize the number of separation discs and interspaces within a given stack height. Furthermore, as previously mentioned, and in particular in large size centrifugal separators, the separation discs can run the risk of touching each other in the compressed state. This is a further reason why there is a minimal height (size) on the interspaces (such as 0.4 mm) in order to secure that the discs are not completely compressed against each other. The invention may hereby also make it possible to reduce this minimal size on the interspaces without risking that adjacent separation discs touch each other. This will also make it possible to provide more separation discs within a given stack height.

The invention makes it possible, due to the small width of the spacing members (i.e. small-sized spacing members), to arrange a distribution pattern in the form of a cluster or concentration of said spacing members in specific surface areas of the separation disc, where the previously mentioned problem of compression arises in the assembled stack of separation discs.

The spacing members may also—as an alternative to the clustered configuration—be configured in an evenly distributed pattern (i.e. the same distance between mutually adjacent small-sized spacing members) throughout the surface of the separation disc, and possibly at a greater concentration compared to "conventional" (large-sized) spacing members.

Finding a suitable distribution pattern may not only depend on the separation disc itself, but also on the design of the centrifugal rotor and the way in which the stack of separation discs is compressed inside the rotor. The deformation of the interspaces in the compressed disc stack may be calculated/simulated in a computer, or by inspecting the actual compressed disc stack. Such inspection could for instance be conducted by making a cast of a compressed disc stack, whereby any suitable casting material is introduced into the compressed disc stack (constituting the mold) inside which the casting material is allowed to solidify. The deformation areas may thereafter be identified, whereby the surface of the separation disc can be configured with (further) small-sized spacing members in the identified areas. Hence, the small-sized spacing members are distributed in a pattern such that equidistant interspaces are obtained in the compressed disc stack.

The small-sized spacing members may be distributed on the surface of the separation disc at a mutual distance in the range of 10-60 mm from each other.

The small-sized spacing members may have a width of 1 mm±.0.5 mm, and preferably a width which is less than 1.5 mm, such as a width from 1 mm and smaller. Furthermore, the spacing members are preferably spot-formed, whereby the width of the spot-formed spacing member corresponds to its diameter. The spot-formed spacing members may be of either half-spherical or cylindrical shape as seen in the direction of its height. One advantage of the invention is that due to the smaller size, compared to the "conventional" large-sized spacing member, the spacing members may be provided in greater number without blocking the flow of liquid mixture. Furthermore, a greater number of small-sized spacing members may be arranged without reducing the effective separating area of the separation disc. It would however also be possible to provide small-sized spacing members of a somewhat elongated shape along the surface of the separation disc—even with lengths which are several times greater than said width of the spacing member. Such elongated spacing members must not be clustered too close together or oriented, in such a way that the liquid mixture is obstructed from flowing through the interspaces.

The spacing members may be integrally formed in one piece with the material of the separation disc. Accordingly, they may be formed in the material in accordance with the (previously mentioned) known techniques for manufacturing separation discs with integrally formed spacing members. The spacing members may be integrally formed by means of so called flow-forming, or they may alternatively be provided by means of any suitable press method—such as the press method disclosed in WO 2010/039097 A1. The small-sized spacing members in accordance with the invention provides an advantage in that only a small amount of the material of the separation disc needs to be displaced during this forming process. Hence, the volume of the displaced material in the integrally formed spacing member is very small, whereby the risk of producing an uneven surface (e.g. on the opposite side of the spacing member) is reduced. Furthermore, ifs easier to displace a small amount of material, and thereby produce a more reliable form on the spacing members than with large-sized spacing members. For instance, a tool (or mandrel) used in the forming of the small-sized spacing members may be configured with only small-sized recesses (e.g., 1 mm.+–.0.5 mm in width) into which the material of the separation disc is displaced, whereby a large number of exclusively small-sized spacing members is formed on the disc surface in a configuration to achieve the equidistant interspaces.

The separation disc may however further comprise large-sized spacing members of greater width than the small-sized spacing members. These may be in the form of separate pieces of narrow strips or circular blanks of sheet metal, which are attached to the surface of the separation disc. Hence, the separation disc is thereby provided with the integrally formed and small-sized spacing members, as well as large-sized "conventional" spacing members which are attached to the surface (by for instance spot welding). The "conventional" spacing members have a much greater width (e.g., a width of 4 mm or more), and may thereby support a greater portion of the forces in the corn-pressed disc stack. Accordingly, a reduced portion of the compressive forces is supported by the small-sized spacing members, which are distributed in order to secure or maintain an equidistant height on the interspaces between the large-sized spacing members.

The large-sized spacing members may be attached to the outer surface of the separation disc, wherein the integrally formed and small-sized spacing members may be formed in the inner surface of the separation disc. In this way, the large-sized spacing members may easily be attached to the outer surface of the separation disc, whereas the integrally formed and small-sized spacing members may be formed on the inner surface in accordance with the known techniques for manufacturing separation discs described in WO 2007/055630 A1 or U.S. Pat. No. 6,526,794 B1.

The height of the small-sized spacing members is the same as "conventional" large-sized spacing members (e.g. somewhere in the range of 0.3 to 0.8 mm). As previously mentioned, this height will be chosen in order to give a suitable size on the interspaces in view of the properties/composition of the liquid mixture which is intended to be separated.

As previously mentioned, the invention is particularly useful for maintaining equidistant interspaces in a stack of thin separation discs (e.g. separation discs having a thickness which is less than 0.6 mm). In order to maximize the number of separation discs in the stack, the invention would be even more useful in maintaining equidistant interspaces between very thin separation discs (e.g. separation discs having a thickness which is less than 0.4 mm). This is typically also the point where said problems of low disc rigidity and/or irregular shaping becomes an issue.

Hence, the invention makes it possible to use very thin separation discs, while equidistant interspaces are maintained by a great number of small-sized spacing members.

Furthermore, the invention relates to separation discs of metal material, which are compressed in relatively robust and large-sized centrifugal rotors for separating liquid mixtures. Accordingly, the separation discs are also of a relative large size. The separation discs will typically have an outer diameter of at least 200 mm, and in many cases above 400 mm. Hence, the small-sized spacing members are distributed in great number over a relatively large surface area on each separation disc. The invention is not however limited to very large separation discs. It may also be used for smaller separation discs, such as those having an outer diameter of 120 mm or above.

A method is provided for manufacturing the separation disc with the small-sized spacing members formed in one piece with the material of the separation disc. The separation disc is manufactured by flow forming it from a metal sheet by means of a roller and a mandrel, the roller forming the separation disc over the mandrel which comprises a truncated conical support surface with recesses corresponding to the small-sized spacing members, the mandrel having a distribution pattern of said recesses to form the small-sized spacing members in one piece with the separation disc in such a way as to provide equidistant interspaces in the compressed stack of separation discs.

In the method it is also possible to make large-sized spacing members of greater width than the small-sized spacing members which are also flow formed by the roller forming the separation disc over the mandrel comprising recesses corresponding to the large-sized spacing members, whereby both small-sized and large-sized spacing members are integrally formed in one piece with the separation disc.

However, as an alternative to the above, small-sized spacing members may be flow formed on the inner surface of the separation disc, wherein large-sized spacing members in the form of separate pieces of narrow strips or circular blanks of sheet metal are attached to the outer surface of the separation disc. These may easily be attached by spot welding them to the outer surface of the flow formed separation disc. Obviously the separation disc should thereby not be provided with any further (or small-sized) spacing members on the opposite (inner) surface area to the large-sized spacing member, in such a way that a faulty double spacing is caused by directly abutting spacing members of mutually adjacent separation discs in the stack.

BRIEF DESCRIPTION OF THE DRAWINGS

Embodiments of the invention will now be described, by way of example, with reference to the accompanying schematic drawings, in which FIG. 1 shows a view of a separation disc in general, FIG. 2 shows an inner-surface-view of a separation disc according to a first embodiment of the invention, FIG. 3 shows an enlarged part of the first embodiment in FIG. 2.

DETAILED DESCRIPTION

Figure 4:
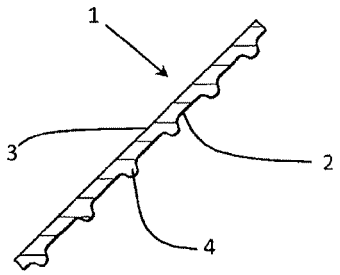
FIG. 4 shows the small-sized and spot-formed spacing members in cross-section of the inner surface of the separation disc.

FIG. 1 shows a very schematic view of a separation disc 1 for a centrifugal separator. A plurality of such separation discs 1 are arranged and compressed on top of each other to form a stack of separation discs inside a centrifugal rotor for separating a liquid mixture. As can be seen, the separation disc 1 has a truncated conical shape with an inner surface 2 and an outer surface 3. The inner surface 2 and/or the outer surface 3 of the separation disc 1 is provided with spacing members (not shown in FIG. 1) to form interspaces between the separation discs 1 in the stack. The general design and function of the separation discs and the centrifugal separator are both well known to a person skilled in the art, and will therefore not be described any further hereinafter.

FIG. 2 shows an inner-surface-view of a separation disc according to a first embodiment of the invention. Hence, an inner surface 2 of the separation disc 1 is shown which is provided with a plurality of spacing members 4, 5 which are also shown in FIG. 3. The spacing members 4 and 5 are formed in one piece with the (metal) material of the separation disc 1. A first ring of the small-sized spacing members extends around the outer perimeter of the separation disc. A second ring has the small-sized spacing member and large-sized spacing members which are larger than the small-sized spacing members. The second ring is spaced radially inwardly from the first ring. A plurality of the small-sized spacing members are between the second ring and the central opening. The small-sized spacing members and the large-sized spacing members alternate in the second ring. This is achieved in a flow forming process described below.

Furthermore, as can be seen in FIG. 3, the spacing members 4 and 5 are of different shapes; a spot-formed spacing member 4 and an elongated spacing member 5. The diameter of the spot-formed spacing member 4 corresponds to its width. Hence, the diameter of the spot-formed spacing member is the same as its width. The elongated spacing member 5 however is several times longer than it is wide, and it is furthermore curved along its length. Both spacing members 4 and 5 in this embodiment each have approximately the same width of 1 mm. The length of the elongated spacing members 5 is however approximately 6 mm, i.e. six times its width. The elongated spacing member 5 may be provided, when there's no "conventional" large-sized spacing member, in order to secure that the elongated spacing members matches with adjacent separation discs due to manufacturing tolerances and inaccuracies (e.g. a play or clearance required for mounting the separation discs on a so called distributer). The large sized spacing members are an elongate shape having a length greater than a width with an elongate side extending in a direction of the length of the large-sized spacing members extends in a circumferential direction of the separation disc. The elongation will secure a support at least in part of the adjoining spacing members 5 of adjacent separation discs, even when these elongated spacing members 5 are slightly displaced relative to one another due to said inaccuracies.

It should be noted that the size of the spacing members 4 and 5 are greatly exaggerated in the drawings for the sake of clarity. In practice they would be of much smaller appearance on the separation disc surface and distributed at a much greater number on the surface. A separation disc 1 of the type shown in this embodiment would typically have an outer diameter 6 of much larger size than 200 mm, e.g. in a larger sized centrifugal rotor the separation discs' outer diameter 6 would be even larger than 400 mm. Accordingly, the spacing members 4 and 5 have a very small size (meaning the width of 1 mm along the surface of the separation disc) in relation to the size of the separation disc. Hence, a great number of these small-sized spacing members 4 and 5 are distributed on the inner surface 2 of the separation disc 1 in such a way as to provide equidistant interspaces in the compressed disc stack.

The shown separation disc 1 is further provided with distribution holes 7 for feeding and distributing the liquid mixture into the interspaces in the stack of separation discs. These distribution holes 7 are well known in the art of centrifugal separators and will not be further described here. The distribution holes 7 are between the second ring and the plurality of the small-sized spacing members forming the first ring.

FIG. 4 shows a cross-section of said small-sized and spot-formed spacing members 4 on the inner surface 2 of the separation disc 1. As can be seen, the spacing members 4 are formed in one piece with the material of the separation disc 1. The presently utilized manufacturing techniques (or the flow forming technique) for producing separation discs 1 is the main reason why the integrally formed spacing members 4 are provided on the inner surface 2. However, they may as well be arranged on the outer surface 3 of the separation disc. The integrally formed spacing members 4 may for instance be provided on the outer surface 2 by a pressing technique. Furthermore, the inner surface 2 of the separation disc 1 is provided with the small-sized spacing members 4 only. Hence, no other spacing members (such as larger sized spacing members) are provided on the surface. However, the small-sized spacing members may also be combined with larger sized spacing member (i.e. having a larger width). Such a combination is described below in a second embodiment of the separation disc shown in FIG. 5.

Figure 5:
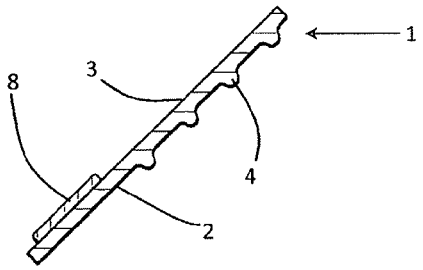
FIG. 5 shows a cross-section of a second embodiment of the separation disc having the small-sized and spot formed spacing members in combination with a larger sized spacing member.

FIG. 5 shows a cross-section of the small-sized and spot formed spacing members 4 in combination with a larger sized spacing member 8. The spacing member 8 is provided on the outer surface 3 of the separation disc 1. Furthermore, it is of substantially greater width (several times greater than the diameter of the small-sized distance members 4). In this particular embodiment the shown spacing member 8 is also spot-formed (i.e. a circular blank of sheet metal) and has a width (or diameter) which is about six times greater than the diameter of the small-sized distance members 4. Consequently, the diameter of the spot-formed and large-sized spacing member 8 is about 6 mm. The large-sized spacing members 8 may however, as an alternative, have an elongated shape (not shown). The large-sized spacing members may be of any known form, e.g. in the form of separate pieces of narrow strips or circular blanks of sheet metal which are attached to the separation disc by a suitable fastening method, such as welding (spot-welding). The large-sized spacing members 8 and the small-sized spacing members 4 have the same height above their respective surfaces 2 and 3. FIG. 5 further shows that the inner surface 2, in an area opposite the large-sized spacing member 8, is not provided with any small-sized spacing members 4. Consequently, the large-sized spacing member 8 of the separation disc 1 will abut a flat inner surface area of an upper adjacent separation disc 1 in the stack. The "conventional" spacing members 8 have a much greater width, and may thereby support a greater portion of the forces in the compressed disc stack. Accordingly, a reduced portion of the compressive forces is supported by the small-sized spacing members 4, which are distributed in order to secure or maintain an equidistant height on the interspaces between the large-sized spacing members 8.

Figure 6:
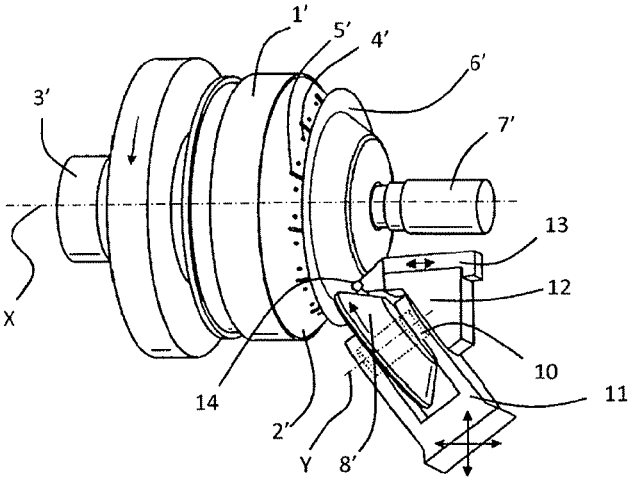
FIG. 6 shows a device and a method for manufacturing the separation disc made of thin sheet metal.

FIG. 6 shows a device and a method for manufacturing the separation disc 1 made of thin sheet metal. The device comprises a mandrel 1' with a truncated conical support surface 2' which by means of a motor M is rotatable about its geometric axis X. In the example shown, the geometric axis X is oriented horizontally, which is of course not necessarily the case. The mandrel 1' has a plurality of recesses 4' and 5' distributed about the geometric axis X on the support surface 2'. The recess 4' and 5' may, as shown, be spot-formed or elongated and straight (as shown) or curved (not shown). Both the spot-formed recesses 4' and the elongated recesses 5' have a depth corresponding to the intended distance (or interspaces) between two adjacent separation discs fitted in a centrifugal separator, e.g. 0.3-0.8 mm. An initially planar circular sheet metal disc 6' is fastened to the apex end of the mandrel 1', coaxially with the support surface 2', by a retainer means 7'. Engagement means (not shown) of both the mandrel 1' and the sheet metal disc 6' ensure that the sheet metal disc 6' accompanies the rotation of the mandrel 1' during the operation.

A roller 8' is disposed at an axial level close to the apex end of the support surface 2' and at a radial distance from the central axis X, the roller 8' being rotatable about a central axis Y. The roller 8' is supported by a shaft 10 which is itself supported for rotation by a retainer 11. The retainer 11 is movable vertically and horizontally by means of a motor (not shown), as indicated by two arrows pointing respectively upwards and downwards and two arrows pointing respectively left and right. The motor for moving the roller 8' vertically and horizontally and guiding the position of the roller 8' relative to the support surface 2' may take many different forms which are well known and are therefore not described in more detail. A further second retainer 12 is arranged on the retainer 11. The second retainer 12 supports a tool 13 comprising a cutter 14. The tool 13 is movable as indicated by two arrows pointing respectively left and right relative to the retainer 12 so that the position of the cutter 14 relative to the surface of the metal sheet 6' can be set in such a way as to achieve a desired cutting depth for the material-removing machining. Such material-removing may not be necessary however if for instance a desired separation disc thickness and smoothness on the outer surface 3 is achieved in the manufacturing process. Hence, the tool 13 and cutter 14 may not be necessary for achieving this.

The separation disc is manufactured by flow forming the metal sheet 6' by means of the roller 8' and the mandrel F. The roller 8' forms the separation disc over the mandrel 1' with the truncated conical support surface 2' having the recesses 4' and 5' of relatively large size. The mandrel 1' is also provided with small-sized recesses 4" and 5" (not shown in FIG. 6) corresponding to the small-sized spacing members 4 and 5. Through the recesses 4', 5', 4" and 5" it is possible to make both large-sized spacing members and small-sized spacing members which are flow formed in one piece with the separation disc 1. The mandrel 1' will in any case be provided with a distribution pattern of the small-sized recesses 4" and 5" to form the small-sized spacing members 4 and 5 in one piece with the separation disc 1 in such a way as to provide equidistant interspaces in the compressed stack of separation discs.

Figure 7:
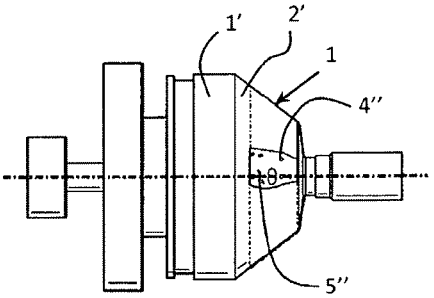
FIG. 7 shows a flow formed separation disc with a see through part showing the small-sized recesses the device.

As an alternative, the mandrel may be provided with only small-sized recesses 4" and 5" (shown in FIG. 7). FIG. 7 shows a flow formed separation disc 1 with a see through part showing the small-sized recesses 4" and 5" on the support surface 2' of the mandrel F. Consequently, the shown mandrel 1' is only provided with small-sized recesses 4" and 5" corresponding to the small-sized (spot-formed and elongated) spacing members 4 and 5 of the separation disc 1 shown in FIG. 2.

Furthermore, small-sized spacing members 4 and 5 may be flow formed on the inner surface 2 of the separation disc 1, wherein large-sized spacing members in the form of said separate pieces may be attached to the outer surface 3 of the separation disc 1 (as previously mentioned).

The invention claimed is:

1. A separation disc for a centrifugal separator, comprising:

an outer surface and an inner surface;

a plurality of small-sized spacing members extending a predetermined height from at least one of the inner surface and the outer surface for providing an interspace between mutually adjacent separation discs in a stack of separation discs, the small-sized spacing members having a width less than 1.5 mm along one of the inner surface and the outer surface of the separation disc; and a distribution pattern of the small-sized spacing members to provide equidistant interspaces in the compressed disc stack, wherein the separation disc has a truncated conical shape, wherein a thickness of the separation disc is less than 0.4 mm, wherein an outer diameter of the separation disc is at least 400 mm, wherein the small-sized spacing members are distributed on one of the inner surface and the outer surface of the separation disc at a distance in the range of 10-60 mm from each other, wherein the small-sized spacing members are spot-formed, and wherein the width of the small-sized spacing members corresponds to a diameter of the small-sized spacing members.

2. The separation disc according to claim 1, wherein the distribution pattern is in the form of an evenly distributed pattern with a same distance between adjacent small-sized spacing members throughout the separation disc.

3. The separation disc according to claim 1, wherein the small-sized spacing members are integrally formed in one piece with the material of the separation disc.

4. The separation disc according to claim 1, further comprising large-sized spacing members having a greater width than a width of the small-sized spacing members.

5. The separation disc according to claim 4, wherein the large-sized spacing members are provided in the form of separate pieces of narrow strips or circular blanks of sheet metal, which are attached to one of the inner surface and the outer surface of the separation disc.

6. The separation disc according to claim 4, wherein the large-sized spacing members are attached to the outer surface of the separation disc, and wherein the small-sized spacing members are formed on the inner surface of the separation disc.

7. The separation disc according to claim 1, wherein the separation disc is provided with distribution holes for feeding and distributing the liquid mixture into the interspaces in a stack of separation discs.

8. A stack of separation discs for a centrifugal separator, the stack of separation discs comprising:

a plurality of separation discs of metal material adapted to be compressed in the stack of separation discs inside a centrifugal rotor for separating a liquid mixture, wherein each separation disc of the plurality of separation discs comprises:

a truncated conical shape having an inner surface and an outer surface;

a plurality of small-sized spacing members extending a predetermined height from at least one of the inner surface and the outer surface for providing interspaces between mutually adjacent separation discs in the stack, a width of which is less than 1.5 mm along one of the inner surface and the outer surface of each separation disc, a distribution pattern of the small-sized spacing members providing equidistant interspaces in the compressed disc stack, wherein the thickness of each separation disc is less than 0.4 mm, wherein the outer diameter of each separation disc is at least 400 mm, wherein the small-sized spacing members are distributed on one of the inner surface and the outer surface of each separation disc at a distance in the range of 10-60 mm from each other, wherein the small-sized spacing members are spot-formed, and wherein the width of the small-sized spacing members corresponds to a diameter of the small-sized spacing members.

9. The stack of separation discs according to claim 8, further comprising large-sized spacing members having a greater width than a width of the small-sized spacing members.

10. The stack of separation discs according to claim 9, wherein the large-sized spacing members are provided in the form of separate pieces of narrow strips or circular blanks of sheet metal, which are attached to one of the inner surface and the outer surface of the separation disc.

11. The stack of separation discs according to claim 9, wherein the large-sized spacing members are attached to the outer surface of the separation disc, and wherein the small-sized spacing members are formed on the inner surface of the separation disc.

12. The stack of separation discs according to claim 9, wherein the separation disc is provided with distribution holes for feeding and distributing the liquid mixture into the interspaces in the stack of separation discs.

13. The stack of separation discs according to claim 8, wherein the small-sized spacing members are integrally formed in one piece with the material of the separation disc.

14. A separation disc for a centrifugal separator, the separation disc being made of a metal material, and having a truncated conical shape with an inner surface and an outer surface, said separation disc comprising:

a plurality of small-sized spacing members extending a certain height above at least one of the inner surface and the outer surface for providing interspaces between mutually adjacent separation discs in a stack of separation discs, the spacing members having a width which is less than 1.5 mm along one of the inner surface and the outer surface of the separation disc;

large-sized spacing members having a greater width than a width of the small-sized spacing members; and a distribution pattern of the small-sized spacing members of the separation disc to provide equidistant interspaces in the compressed disc stack, wherein the thickness of the separation disc is less than 0.4 mm, wherein the outer diameter of the separation disc is at least 400 mm, and wherein the small-sized spacing members are distributed on one of the inner surface and the outer surface of the separation disc at a distance in the range of 10-60 mm from each other.

15. The separation disc for a centrifugal separator according to claim 14, wherein the small-sized spacing members are spot-formed, and wherein a width of the small-sized spacing members corresponds to a diameter of the small sized spacing members.

16. The separation disc for a centrifugal separator according to claim 14, wherein the large-sized spacing members are provided in the form of separate pieces of narrow strips or circular blanks of sheet metal, which are attached to one of the inner surface and the outer surface of the separation disc.

17. The separation disc for a centrifugal separator according to claim 14, wherein the large-sized spacing members are attached to the outer surface of the separation disc, and wherein the small-sized spacing members are formed on the inner surface of the separation disc.

18. The separation disc for a centrifugal separator according to claim 14, wherein the separation disc is provided with distribution holes for feeding and distributing the liquid mixture into the interspaces in a stack of separation discs.

19. The separation disc for a centrifugal separator according to claim 14, wherein the small-sized spacing members are integrally formed in one piece with the material of the separation disc.

* * * * *